US007784655B2

(12) United States Patent
Su

(10) Patent No.: US 7,784,655 B2
(45) Date of Patent: Aug. 31, 2010

(54) BELT BUCKLE

(76) Inventor: Yung-Fa Su, No. 12, An Lin 3rd Street, Yen Chao Hsiang, Kaohsiung Hsien (TW)

( * ) Notice: Subject to any disclaimer, the term of this patent is extended or adjusted under 35 U.S.C. 154(b) by 776 days.

(21) Appl. No.: 11/563,696

(22) Filed: Nov. 28, 2006

(65) Prior Publication Data

US 2008/0120813 A1 May 29, 2008

(51) Int. Cl.
*A44B 11/00* (2006.01)

(52) U.S. Cl. ..... 224/163; 24/163 K; 40/640

(58) Field of Classification Search ..... 224/163; 24/163 K; 63/1.14, 18, 19; 40/640
See application file for complete search history.

(56) References Cited

U.S. PATENT DOCUMENTS 733,029 A * 7/1903 Gosling ..... 63/29.1
749,995 A * 1/1904 Johnson ..... 24/163 R
1,878,792 A * 9/1932 Marinsky ..... 224/163
1,972,522 A * 9/1934 Keller ..... 368/278
2,840,875 A * 7/1958 Chambers ..... 24/163 R
2,931,196 A * 4/1960 Liftman ..... 63/31
3,155,236 A * 11/1964 Reno ..... 206/82
3,969,836 A * 7/1976 DuBois ..... 40/665
4,399,910 A * 8/1983 Gutentag ..... 206/82
4,435,963 A * 3/1984 Shigeru ..... 63/18
4,534,063 A * 8/1985 Krumin et al. ..... 455/344
4,570,308 A * 2/1986 Weisgerber ..... 24/163 K
4,891,956 A * 1/1990 MacDonald ..... 63/3
4,972,557 A * 11/1990 Williams ..... 24/163 K
5,102,023 A * 4/1992 Nguyen ..... 224/163
5,414,948 A * 5/1995 Kudo ..... 40/651
6,108,276 A * 8/2000 Chen ..... 368/10
6,253,974 B1 * 7/2001 Park ..... 224/163
6,366,538 B1 * 4/2002 Anderson et al. ..... 368/10
6,886,724 B2 * 5/2005 Hung ..... 224/163
2007/0084892 A1 * 4/2007 Korlath ..... 224/163

* cited by examiner

*Primary Examiner*—Justin M Larson
(74) *Attorney, Agent, or Firm*—Leong C. Lei

(57) ABSTRACT

The belt buckle has an indentation on the front surface housing a pin-joined and foldable carrier member. The carrier member has an opening allowing the insertion and removal of a flat object into and from the carrier member.

2 Claims, 15 Drawing Sheets

BELT BUCKLE

TECHNICAL FIELD OF THE INVENTION

The present invention generally relates to belt buckles, and more particularly to a belt buckle having a carrier member for carrying a flat object.

DESCRIPTION OF THE PRIOR ART

As shown in FIG. 1, a conventional belt 1 has a belt buckle 12 fixedly attached to one end of a belt member 11. The other end of the belt member 11 is then locked to the belt buckle 12 for fastening the belt 1 around the waist. The basic structure of the belt just described has not been changed for a very long time. Variations are usually centered around the material used for the belt member 11, how the belt buckle 12 locks the tip of the belt member 11, or the ornamental design of the belt buckle 12.

SUMMARY OF THE INVENTION

The present invention provides a novel belt buckle which has an indentation on the front surface housing a pin-joined and foldable carrier member. The carrier member has an opening allowing the insertion and removal of a flat object into and from the carrier member.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
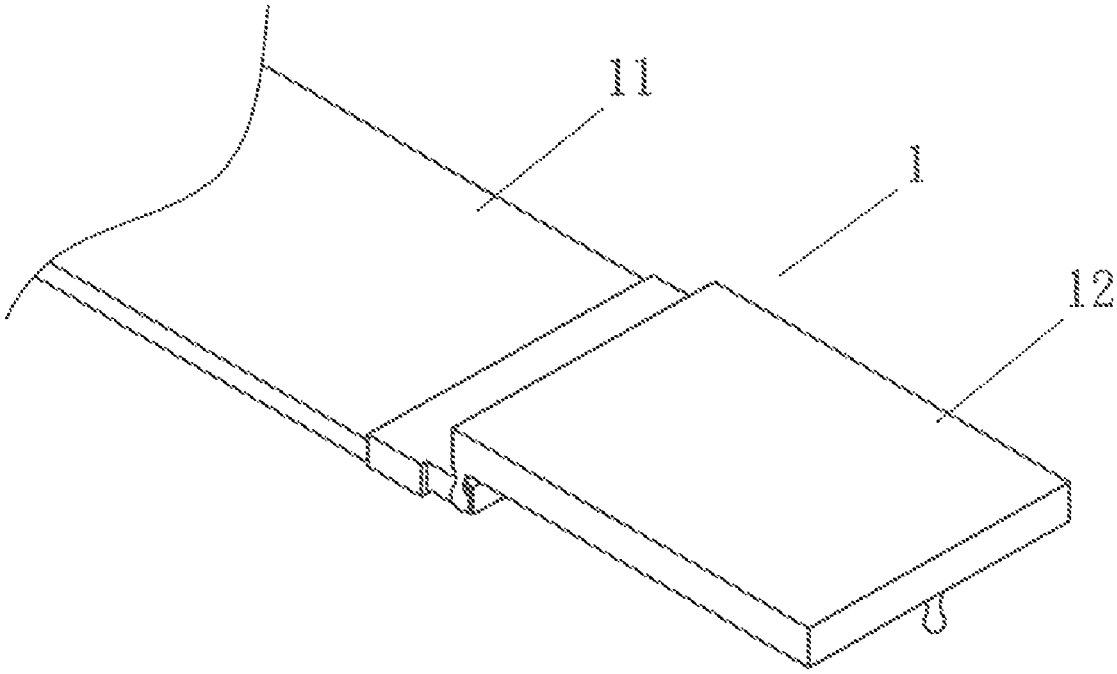
PRIOR ART FIG. 1
FIG. 1 is a perspective diagram showing a conventional belt buckle.
Figure 2:
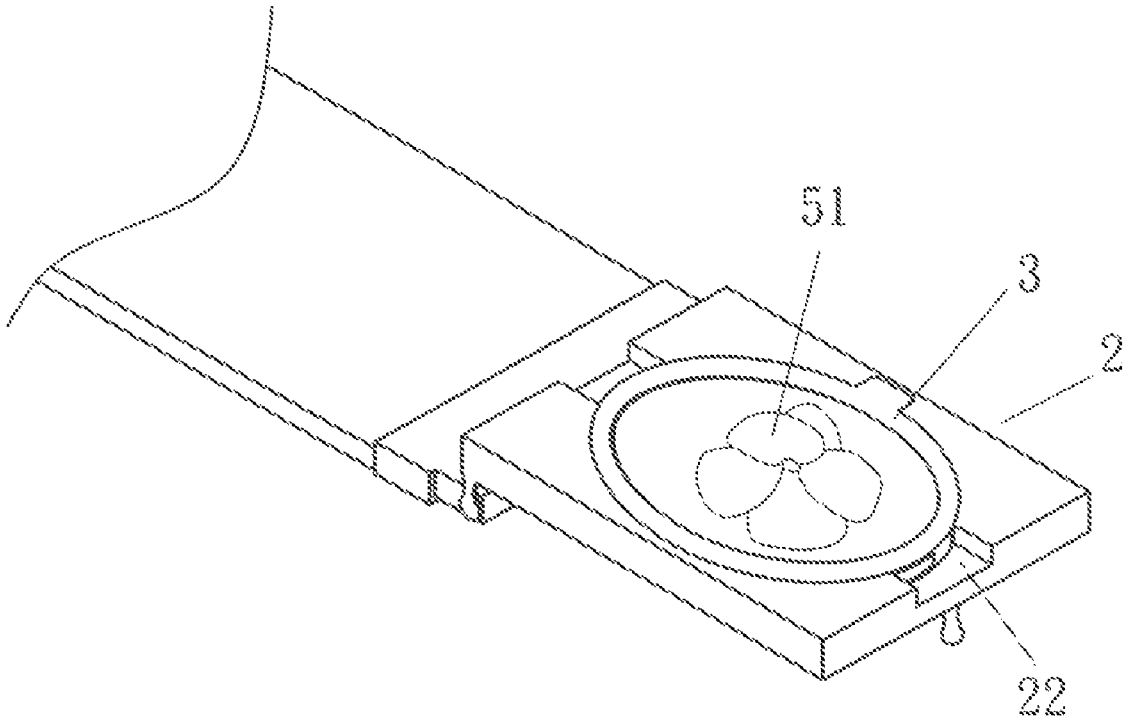
FIG. 2 is a perspective diagram showing a belt buckle according to a first embodiment of the present invention.
Figure 3:
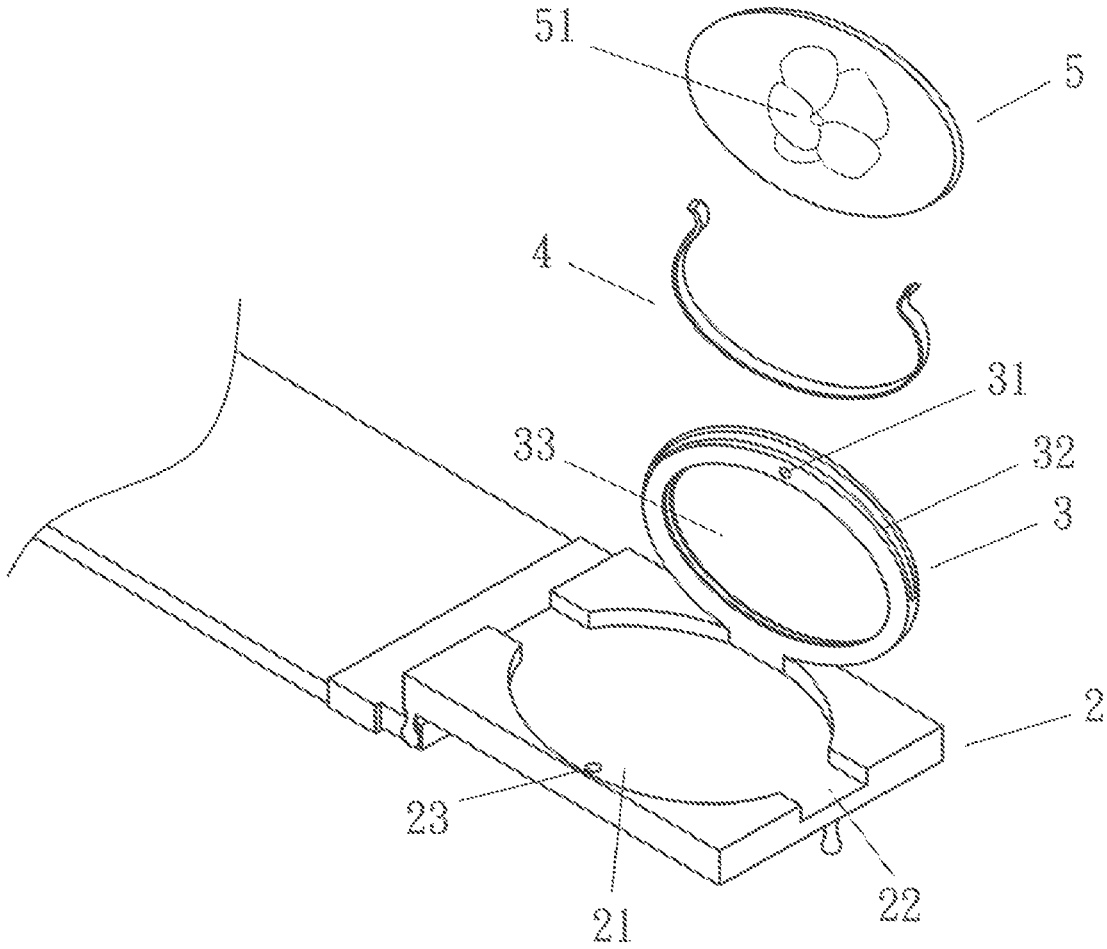
FIG. 3 is a perspective exploded diagram showing the various components of the belt buckle of FIG. 2.

As shown in FIGS. 2 and 3, a belt buckle 2 according to an embodiment of the present invention has an indentation 21 on the front surface of the body of the belt buckle 2. The indentation 21 runs parallel to the belt member from one end of the belt buckle 2 to the other end, thereby forming two notches 22 on the two end surfaces of the belt buckle 2, respectively. The indentation 21 allows the accommodation of a carrier member 3 which is pin-joined to an appropriate location along the circumference of the indentation 21 so that the carrier member 3 can be flipped outward to reveal the inside of the indentation 21 or flipped inward to be tucked inside the indentation 21. In the present embodiment, the carrier member 3 has a ring-shaped body with a center circular storage space 33. To fix the carrier member 3 when it is positioned inside the indentation 21, a magnet 31 is positioned on the inner surface of the carrier member 3 so that, when the carrier member 3 is placed inside the indentation 21, the magnet 31 will be attracted by a corresponding magnet 23 positioned at the bottom of the indentation 21. Also in the present embodiment, the carrier member 3 has a slot opening 32 along the outer circumference so that its storage space 33 is accessible through the slot opening 32. As such, a flat C-shaped holder element 4 can be squeezed into the carrier member 3 via the slot opening 32. The shape of the aperture of the holder element 4 is conformed to, but slightly smaller than, that of the storage space 33 so that the holder element 4 will be surrounding the storage space 33. Then, a flat carried object 5 shaped similarly to the storage space 33 can also be squeezed into the storage space 33 via the slot opening 32. As such, the carried object 5 will first push open the gap of the holder element 4's C-shaped body and, when the carried object 5 is inside the storage space 33, it is clamped by the holder element 4 and is therefore fixedly positioned inside the storage space 33. Please note that the storage space 33, the holder element 4, and the carried object 5 are not limited to the circular shapes as depicted in the drawings. Any other appropriate shape such as square, rectangle, diamond, polygon, or oval is possible.

Figure 4:
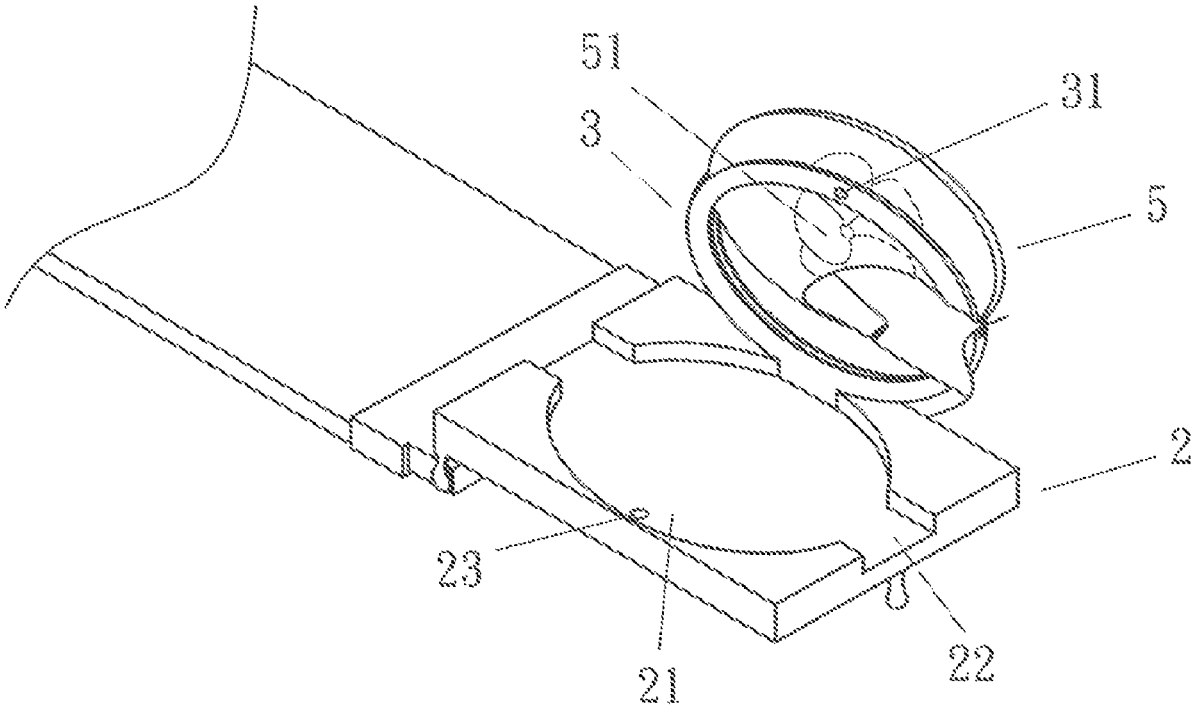
FIG. 4 is a perspective diagram showing the insertion and removal of the carried object into and from the carrier member of the belt buckle of FIG. 2.

The carried object 5 can have ornamental design 51 such as a company, club, or team logo or even a picture on its front surface for enhanced appearance. In the present embodiment, the carried object 5 is very much like a coin and therefore can be used in various occasions. For example, on the gold course, it can be used by a golfer to mark the position of the golf ball, instead of using a coin or other object. To remove the carried object 5, a user presses the carrier member 3 using the thumb through one of the notches 21 and flips the carrier member 3 forward. Then, as shown in FIG. 4, the user can use the thumb to push the carried object 5 to break out the confinement of the holder element 4 and, subsequently, out of the carrier member 3 via the slot opening 32. In some embodiments, the carried object 5 is made of a special energy-radiating mineral for health improvement purpose as the belt buckle 2 is located close to the lower part of the abdomen which is traditionally considered as the energy center of human body by some people. Also in some embodiments, the carried object 5 is actually a "key" (e.g., a remote-sensing pass) for access control so that the user will never forget to carry his or her pass.

Figure 5:
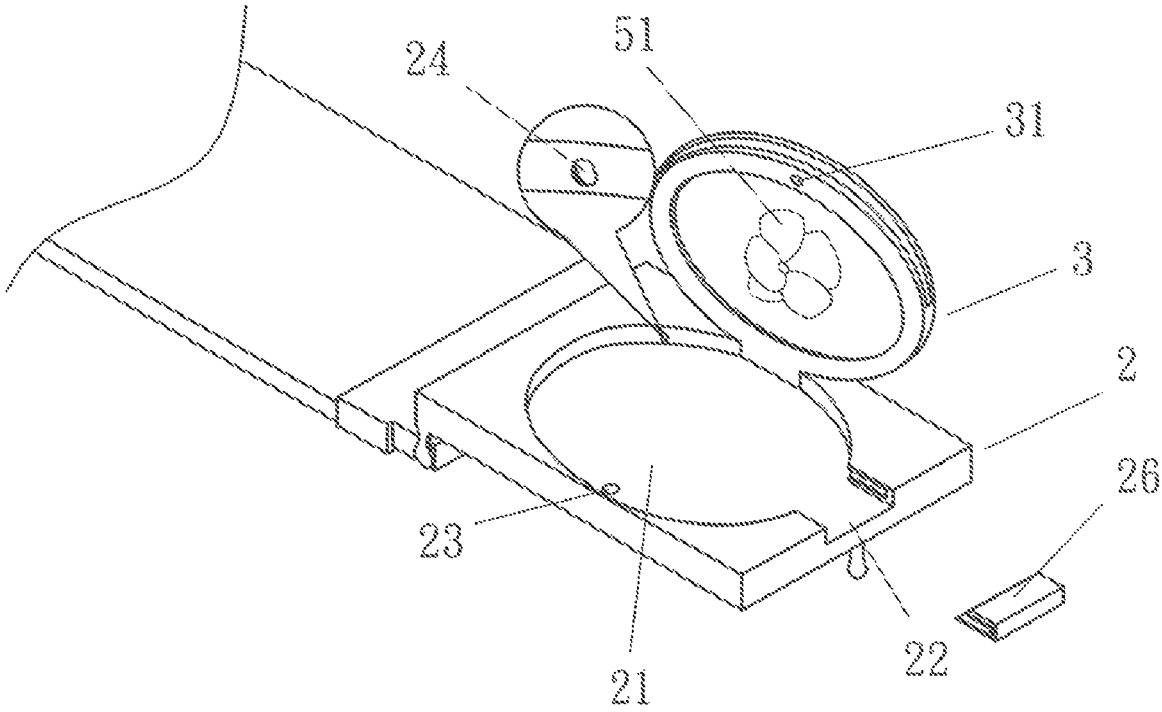
FIG. 5 is a perspective diagram showing a belt buckle according to a second embodiment of the present invention.
Figure 6:
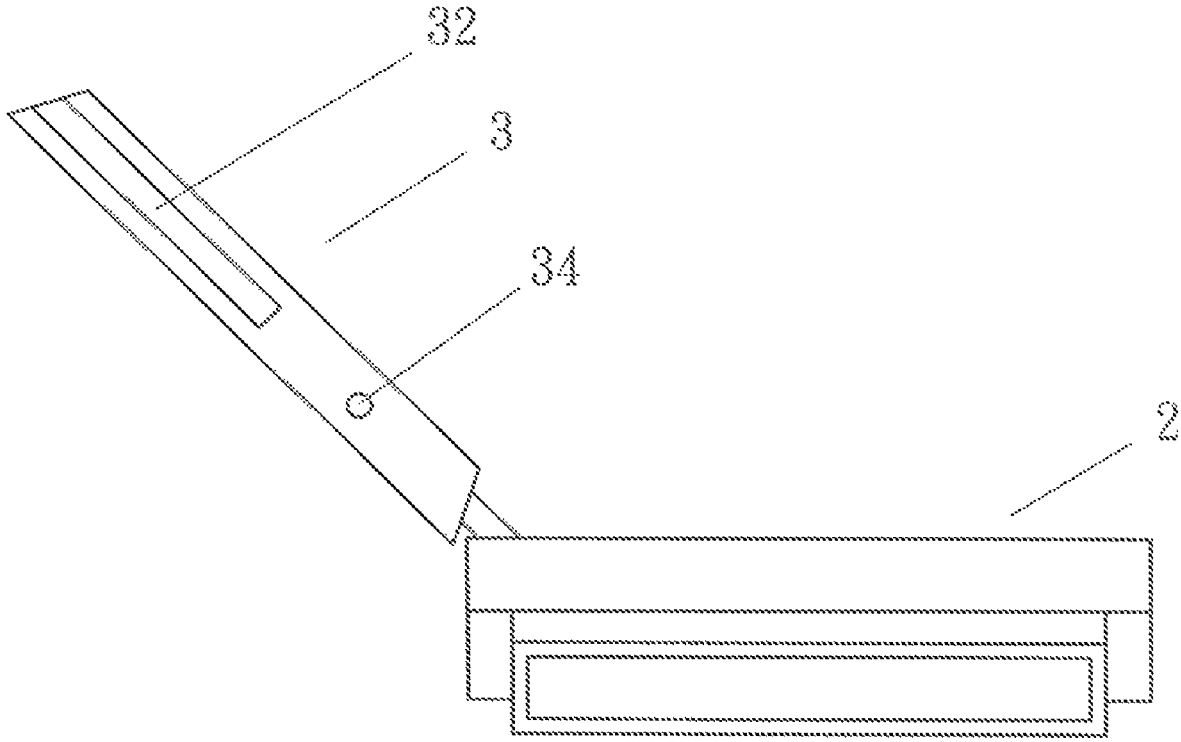
FIG. 6 is a profile diagram showing the belt buckle of FIG. 5.
Figure 7:
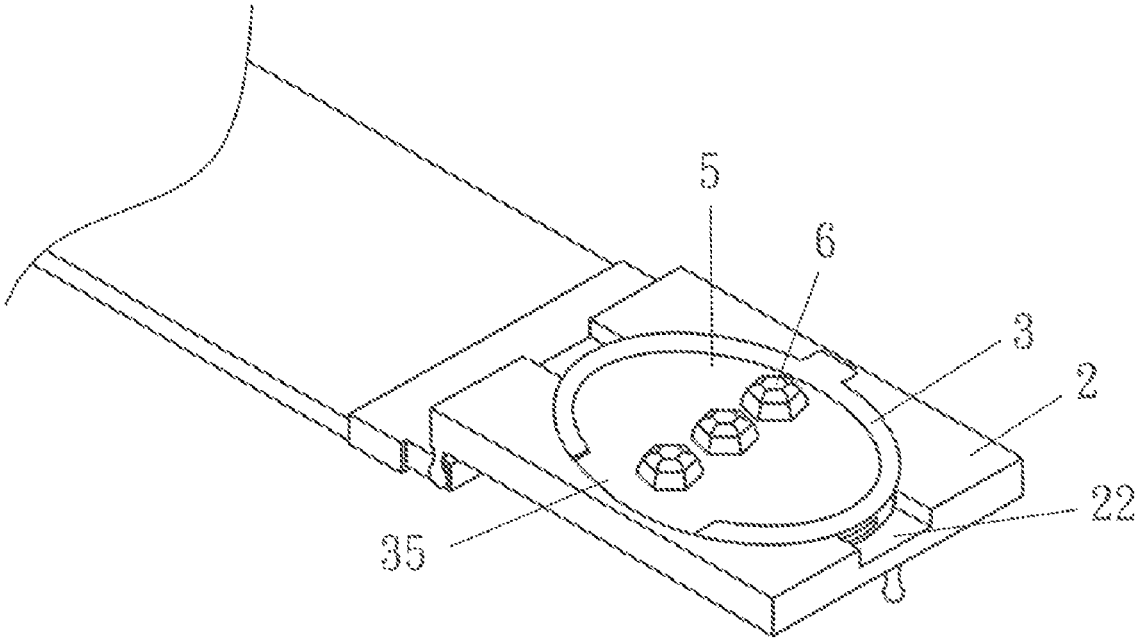
FIG. 7 is a perspective diagram showing a belt buckle according to a third embodiment of the present invention.

FIGS. 5 and 6 show another embodiment of the present invention, whose main purpose is to enhance the retention of the carrier member 3 inside the belt buckle 2. As illustrated, in addition to the magnet 31, one or more holes 34 are provide along the outer circumference of the carrier member 3. Correspondingly, one or more small balls 24 are provided along the circumference of the indentation 21, partially protruding into the storage space 33. The balls 24 are pressed against by springs embedded inside the belt buckle 2. As such, when the carrier member 3 is placed inside the indentation 21, the balls 24 protrude into the holes 34 to provide additional confinement to the carrier member 3 when it is inside the storage space 33. Also shown in FIG. 5, a slidable wedge 26 having a slant surface interfacing with the carrier member 3 is provided in the notch 22. By sliding the wedge 26 towards the carrier member 3, the slant surface of the wedge 26 lifts the carrier member 3 out of the indentation 21. The carrier member 3 then can be further flipped outward.

Figure 8:
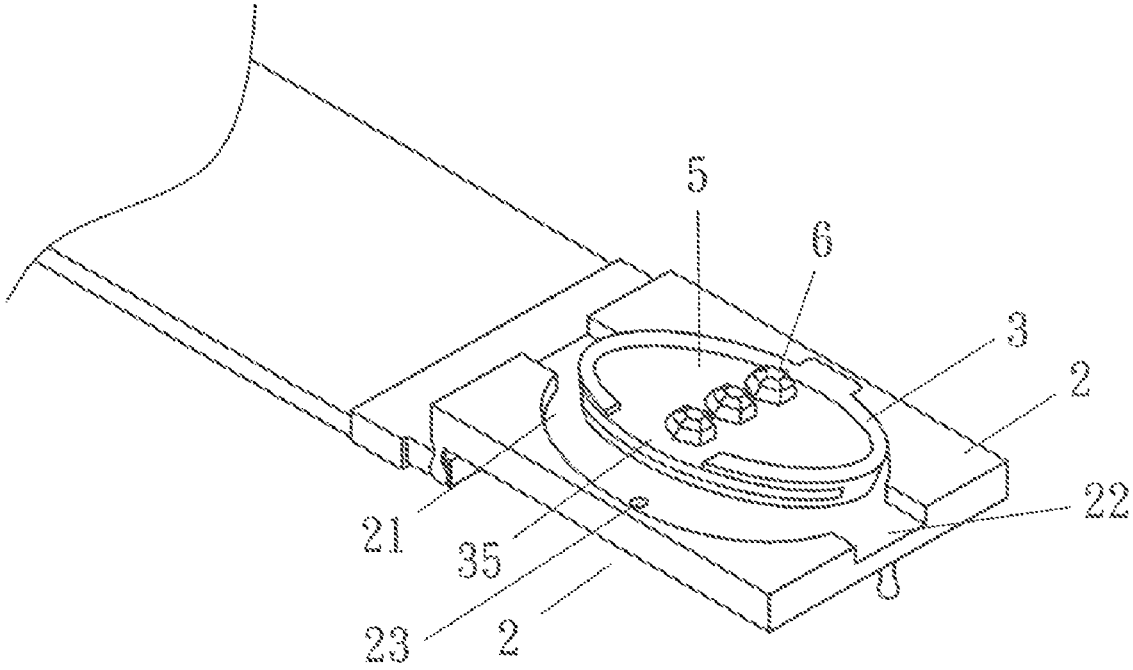
FIGS. 8 and 9 are perspective diagrams showing two scenarios of the belt buckle of FIG. 7.
Figure 9:
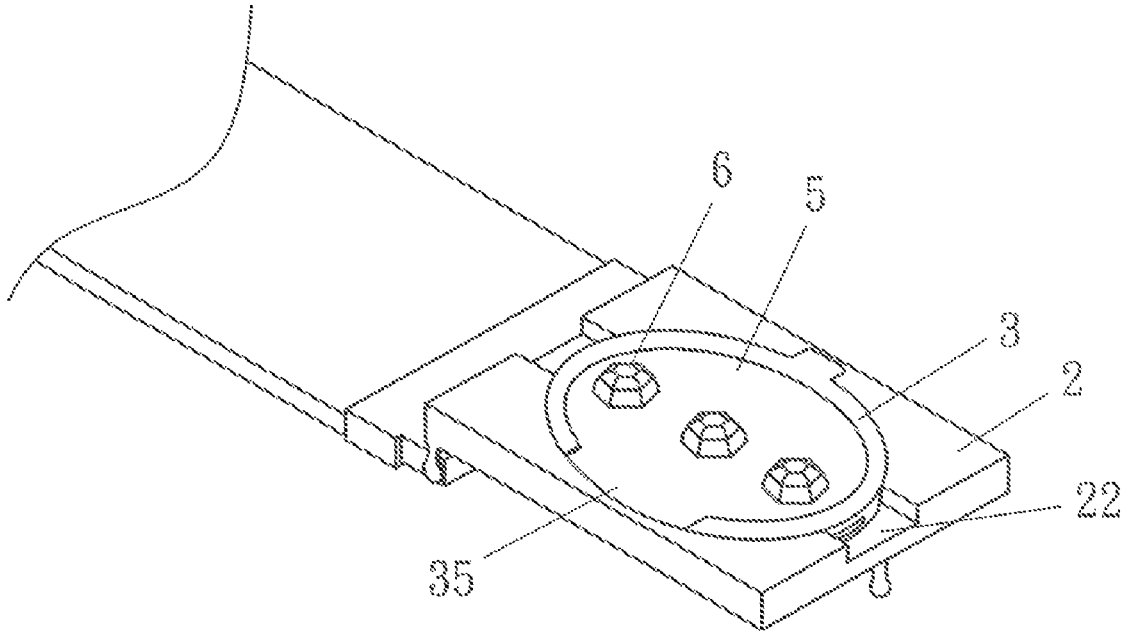

As shown in FIG. 8, the front surface of the carried object 5 is beset with a number of protruding elements 6. In some embodiments, the protruding elements 6 are diamonds or other valuable stones or metals to increase the value of the belt buckle 2. In some other embodiments, the protruding elements 6 can also form a special three-dimensional pattern. As also illustrated in FIG. 8, the slow opening 32 of the carrier member 3 has a gap 35 so that the protruding elements 6 can pass through the gap 35 when removing or inserting the carried object 5 out of or into the carrier member 3. As shown in FIG. 9, some embodiment of the present invention allows the carried object 5 to be rotated inside the carrier member 3 so that the protruding elements 6 are not aligned with the gap 35. This can prevent the accidental removal of the carried object 5 from the carrier member 3.

Figure 10:
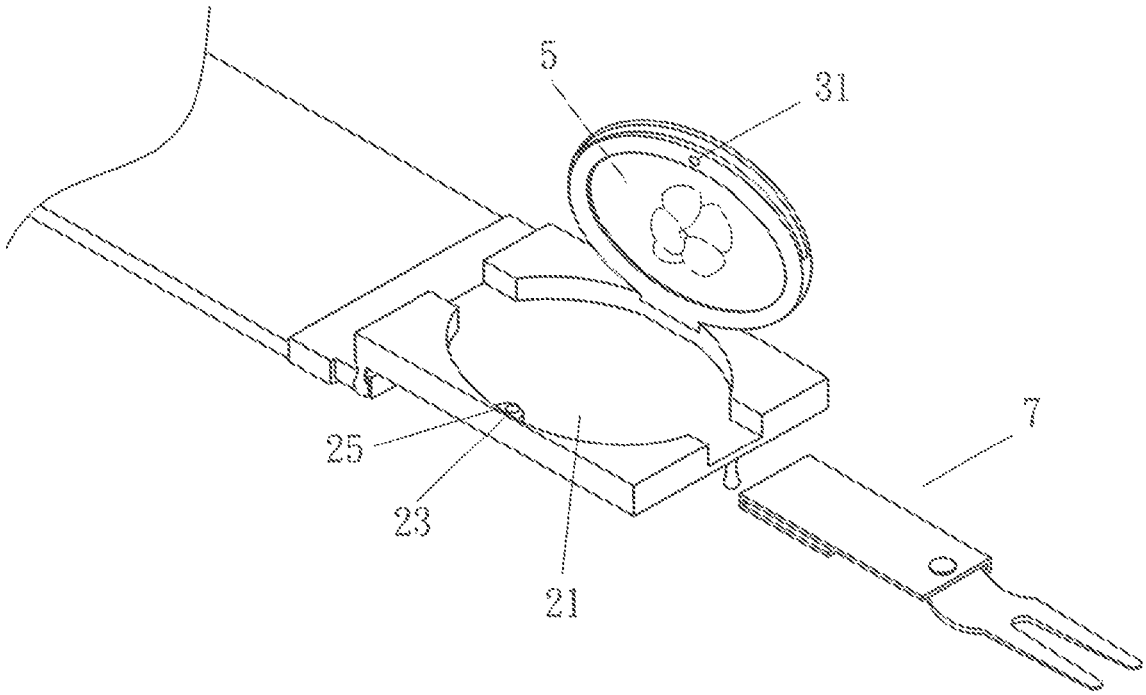
FIGS. 10 and 11 are perspective diagrams showing a belt buckle according to a fourth embodiment of the present invention providing the carriage of an additional object.
Figure 11:
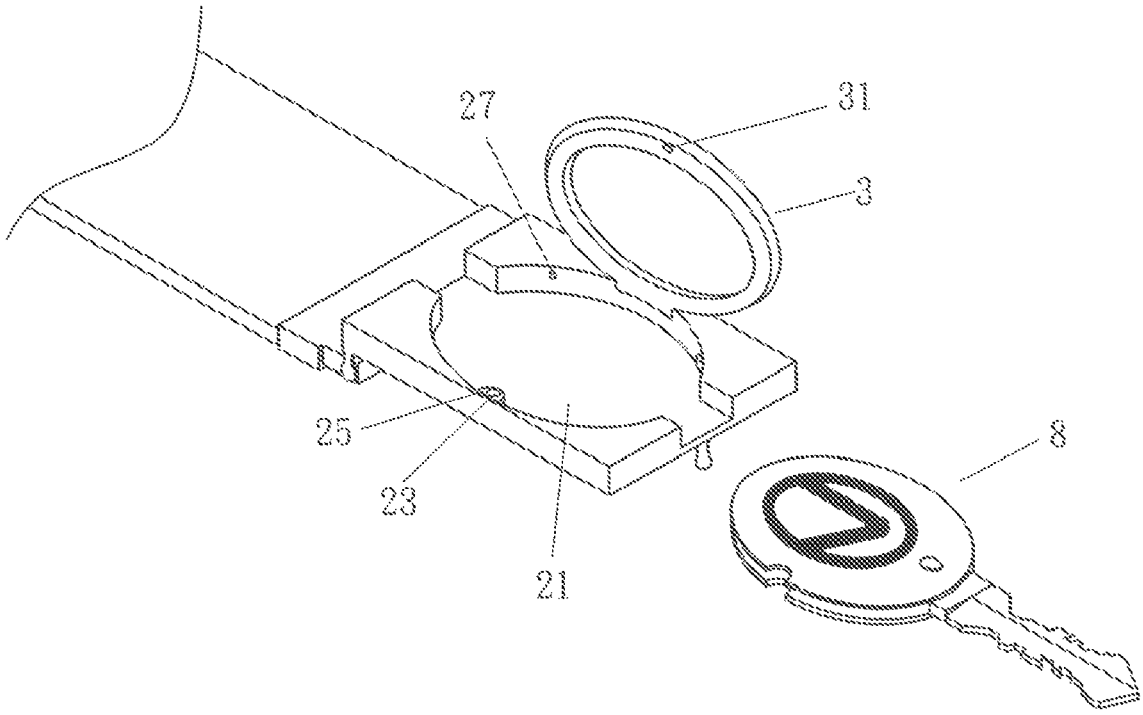

As shown in FIG. 10, another embodiment of the present invention has an indentation 21 deeper than the thickness of the carrier member 3. Then, by providing a block 25 with magnet 23 along the circumference and adjacent to the front of the indentation 21, the carrier member 3 can be held on the front of the indentation 21 and a portion of the indentation 21 is reserved for the carriage of some flat object. One example is a small and retractable digger 7 commonly used by golfers as shown in FIG. 10. Another example is a retractable spare car key 8 shown in FIG. 11. This spare car key 8 allows a user, when the car is required to be temporarily parked without shutting down the engine, to use the spare car key 8 to lock the car doors. As also shown in FIG. 11, one or more small balls 27 are provided along the circumference of the indentation 21, partially protruding into the indentation 21. The balls 27 are pressed against by springs embedded inside the belt buckle 2. As such, when the car key 8 is placed inside the indentation 21, the balls 27 protrude to position the car key 8 steadily.

Figure 12:
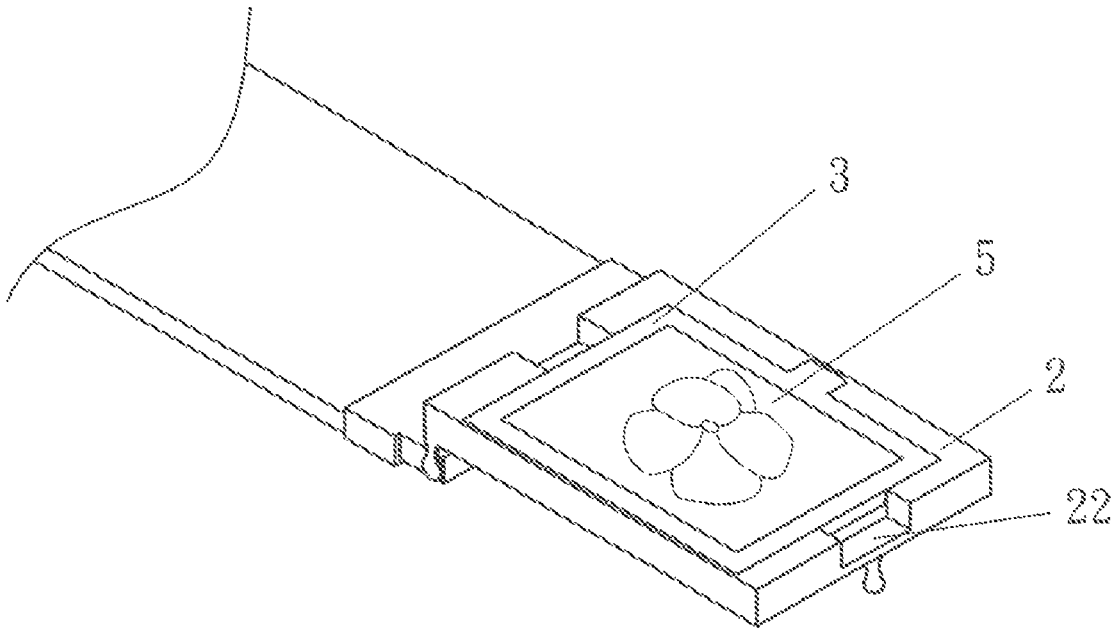
FIGS. 12 and 13 are perspective diagrams showing a belt buckle according to a fifth embodiment of the present invention providing the carriage of an additional object.
Figure 13:
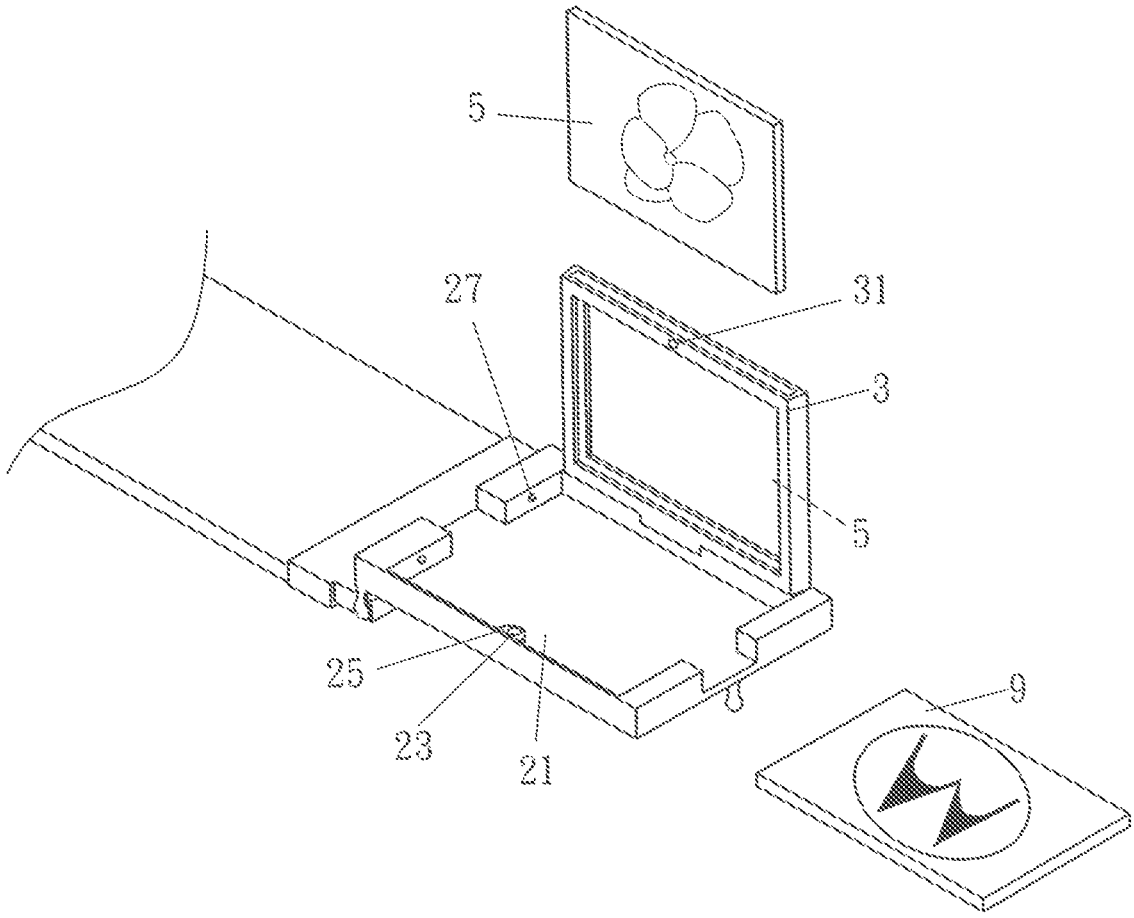

As shown in FIGS. 12 and 13, yet another embodiment of the present invention has a rectangular shaped carrier member 3. Similar to the previous embodiments, a carried object 5 is embedded inside the carrier member 3 and some additional space inside the indentation 21 is used to carry a flat rectangular object such as a backup battery for cellular or mobile phones.

Figure 14:
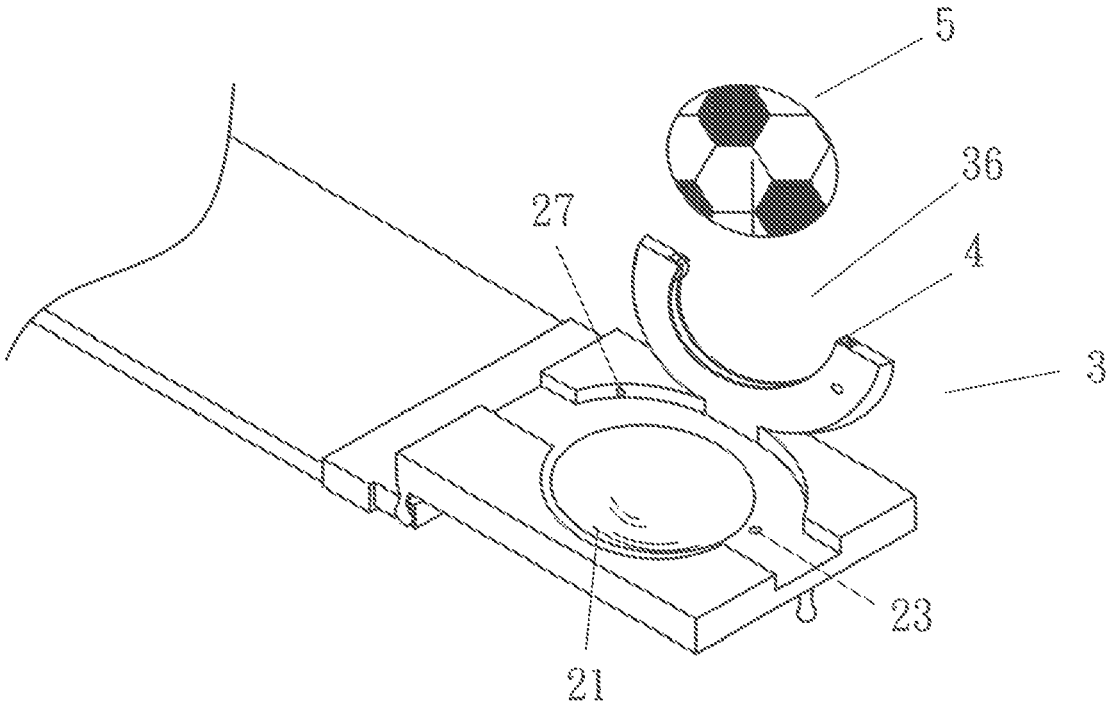
FIG. 14 is a perspective diagram showing a belt buckle according to a sixth embodiment of the present invention having a spherical carried object.
Figure 15:
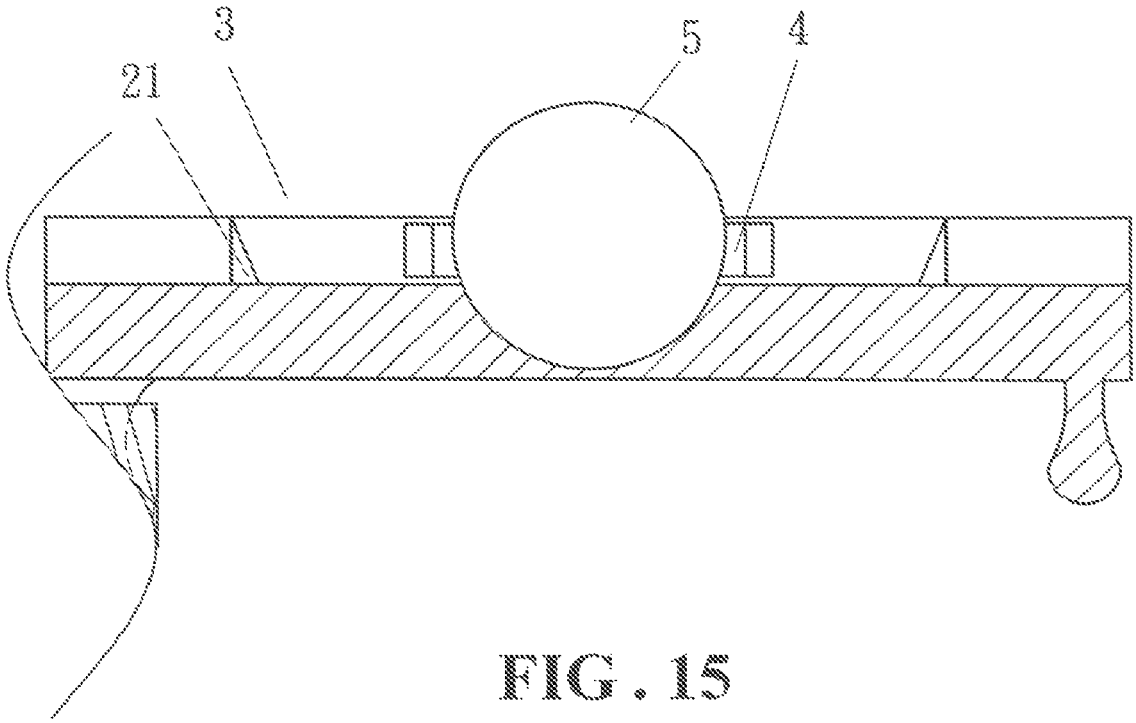
FIG. 15 is a sectional diagram showing the belt buckle of FIG. 14.

As shown in FIGS. 14 and 15, still another embodiment of the present invention has spherical carried object 5. As illustrated, the indentation 21 therefore has a corresponding semi-spherical hole to accommodate the carried object 5. In addition, the carrier member 3 has an arc shape with a semi-circular opening 36 to fit the spherical shape of the carried object 5. The C-shaped holder element 4, as in the previous embodiments, clamps the carried object 5 so that the carried object 5 is steadily position.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A belt buckle for a belt member comprising:

a body having a front surface provided with an indentation; said indentation running parallel to said belt member from an end of said body to another end of said body thereby forming two notches on two end surfaces of said body;

a carrier member pin-joined to a location along a circumference of said indentation thereby enabling said carrier member to be flipped outward to reveal inside of said indentation or flipped inward to be tucked inside said indentation, said carrier member having an outer circumference provided with a slot opening, said carrier member having a ring-shaped body with a center circular storage space which is accessible through said slot opening;

a C-shaped holder element squeezed into said carrier member via said slot opening;

a carried object shaped similarly to said storage space and squeezed into said storage space via said slot opening, wherein the carried object pushes open a gap of the C-shaped holder element and is confined and clamped within the C-shaped holder element to be fixedly positioned in said storage space;

a first magnet positioned on an inner surface of said carrier member; and a second magnet positioned at a bottom of said indentation so that when said carrier member is placed inside said indentation, said first magnet will be attracted by said second magnet;

wherein when desired to remove said carried object, a user presses said carrier member using fingers through said notches and flips said carrier member for pushing said carried object out of said carrier member via said slot opening by breaking out of the confinement of said C-shaped holder element.

2. The belt buckle for a belt member as claimed in claim 1, wherein said carried object has an ornamental pattern.

* * * * *